United States Patent [19]

Yamaguchi et al.

[11] Patent Number: 4,894,088

[45] Date of Patent: Jan. 16, 1990

[54] PELLET FOR FABRICATING METAL MATRIX COMPOSITE AND METHOD OF PREPARING THE PELLET

[75] Inventors: Yoshihiro Yamaguchi; Hiroyuki Murata, both of Kobe; Shunichi Mizukami, Akashi; Kenichiro Ohuchi, Kobe; Hiroyuki Morimoto, Himeji; Jun Hirose, Kobe, all of Japan

[73] Assignee: Kabushiki Kaisha Kobe Seiko Sho, Kobe, Japan

[21] Appl. No.: 133,434

[22] Filed: Dec. 15, 1987

[30] Foreign Application Priority Data

Dec. 16, 1986 [JP] Japan ..... 61-300540

[51] Int. Cl.[4] ..... C22C 29/12

[52] U.S. Cl. ..... 75/232; 75/236; 75/243; 75/244; 75/245; 75/246; 75/248; 419/11; 419/12; 419/15; 419/17; 419/19; 419/23

[58] Field of Search ..... 75/232, 235, 239, 240, 75/236, 237, 243, 244, 245, 248, 246; 419/11-13, 17, 19, 23

[56] References Cited

U.S. PATENT DOCUMENTS

| | | | |
|---|---|---|---|
| Re. 29,865 | 12/1978 | Steigelman et al. | 75/240 |
| 4,224,380 | 9/1980 | Bovenkerk et al. | 428/545 |
| 4,604,259 | 8/1986 | Whitman | 75/247 |
| 4,623,388 | 11/1986 | Jatkar et al. | 75/232 |
| 4,639,281 | 1/1987 | Sastry et al. | 148/407 |
| 4,702,770 | 10/1987 | Pyzik et al. | 75/236 |

*Primary Examiner*—Stephen J. Lechert, Jr.
*Attorney, Agent, or Firm*—Oblon, Spivak, McClelland, Maier & Neustadt

[57] ABSTRACT

A pellet for fabricating a metal matrix composite is made of a mixture of a matrix member of a metal powder and at least one reinforcement selected from whiskers, short fibers and suitable particles, the reinforcement being uniformly distributed in a matrix of the metal powder and said mixture being kept in a shape with a binder, wherein said pellet has a surface layer of dried and rigid portion of said mixture which is rigid enough to keep its shape under an external pressure applied thereto. The pellet is formed from a flat cake of the mixture separated from a slurry consisting of a solution medium and the mixture dispersed therein uniformly. Alternatively, the pellet is formed from the mixture in a dried condition with a granulation binder diluted with a solution medium.

14 Claims, 3 Drawing Sheets

PELLET FOR FABRICATING METAL MATRIX COMPOSITE AND METHOD OF PREPARING THE PELLET

BACKGROUND OF THE INVENTION

1. Field of the Invention

The present invention relates to improvement of the material for forming reinforced metal matrix composites and the method of manufacturing the same, and more particularly forming the mixture of a reinforcement such as ceramic fibers or particles and a metal powder which permits fabrication of the metal matrix composites of improved quality and property.

2. Prior Art

It is known that a light weight metal such as aluminum, aluminum alloy, titanium, titanium alloy, magnesium, or magnesium alloy are reinforced with a light weight reinforcement having properties of high degrees of strength, elastic modulus and heat resistance such as whiskers, short fibers or particles of alumina (aluminum oxide), silicon carbide, silicon nitride or other ceramics to thereby fabricate metal matrix composites (referred to as MMC hereinbelow) material. The thus constructed composite exhibits a relatively high strength, stiffness, heat resistance and wear resistance, and thus is suitable for use in manufacturing parts of space and air crafts, an automobile car, an industrial machine or equipment and sporting goods which require light weight, high stiffness, strength and/or high heat resistance.

U.S. Pat. No. 3,833,697 discloses one of typical methods of manufacturing MMC, in which the whiskers and the metal powder are mixed with each other and the mixture is shaped by hot pressing process. The disclosed method is disadvantageous in that the property of the MMC is directly affected by the dispersed condition of whiskers in the matrix of the metal powder. The method therefore depends on the extent to which the two materials, whiskers and metal powder, are uniformly mixed with each other. With this drawback in view, the applicant of this invention has proposed in Japanese Patent Laid-Open Publication Nos.60-251922 and 62-89801 that methods and apparatus for mixing whiskers and a matrix metal powder in a uniformly distributed state, in which the ultrasonic vibration is first imparted to unravel entangled whiskers for dispersion in an organic solution, which is then stirred with the metal powder added therein to form a slurry of the whiskers and the metal particles, and the slurry is separated into the organic solution and the mixed components through processes of filtration and drying. The proposed method achieves a uniformly dispersed mixture of the whiskers and metal powder, thereby enabling fabrication of MMC of high quality.

The last-mentioned method, however, has other problems newly witnessed during the processes of filtering the slurry and drying the mixed components separated from the latter. More particularly, a lingered filtration of the slurry allows the whiskers and the metal particles to settle at different rate, thus resulting in a sedimentation or cake which has variation in whisker content in the direction of depth thereof. Further, the poor permeability and aeration of the cake elongates the time of drying if the cake of sedimentation is to be directly dried. Comminution of the cake for drying is apt to cause an objectionable segregation of the components, i.e. separation of whiskers and a metal powder due to different fluidity of components, or create a dust pollution.

There is another problem common to the conventional method of forming the mixture of a metal powder and reinforcement such as various short fibers, whiskers or various particles of ceramics or carbon. The mixture prepared in the above-described manner is often subject to segregation of the components before the mixture is used to fabricate a product such as MMC, and causes nonuniform distribution of the components and of the filling density due to its poor fluidity when the mixture is charged into the mold, with the result that the product made therefrom has only a poor quality.

SUMMARY OF THE INVENTION

According to a first aspect of the present invention, a material for forming a metal matrix composite is a pellet made of the mixture of a matrix member of a metal powder and at least one reinforcement selected from whiskers, short fibers and suitable particles, the reinforcement being uniformly distributed in the matrix member and said mixture being kept in a shape with a granulation binder, wherein said pellet has a surface layer of dried and solidified portion of said mixture which is rigid enough to keep its shape under an external compressing force applied thereto.

According to a second aspect of the invention, a method of forming a pellet made of the mixture of a matrix member of a metal powder and at least one reinforcement selected from whiskers, short fibers and suitable particles comprises the steps of:

preparing a slurry consisting of a solution medium in which the matrix powder and the reinforcement are mixed uniformly with each other;

removing continuously the solution medium out of the slurry for forming a flat cake of the mixture of the matrix powder and the reinforcements;

kneading the cake with a granulation binder added therein to make the cake into small pieces or pellets; and drying the pellets such that the pellets have a rigid and dried surface layer.

According to a third aspect of the invention, a method of forming a pellet made of the mixture of a matrix member of a metal powder and at least one reinforcement selected from suitable fibers and particles comprises the steps of:

preparing the mixture of the matrix powder and the reinforcements mixed uniformly with each other under drying mixing condition;

kneading the mixture with a granulation binder added therein to make the mixture into small pieces or pellets, said granulation binder being diluted with a solution medium; and drying the pellets such that the pellets have a rigid and dried surface layer.

It is therefore an object of the present invention to provide a mixture in the form of pellet from which a metal matrix composite is fabricated, and in which mixture a matrix member of a metal powder and at least one reinforcement selected from whiskers, short fibers and a ceramic powder are uniformly mixed with each other devoid of segregation.

Other object of the invention is to provide a pellet of a mixture for fabricating the metal matrix composite, the pellet eliminating difficulties in its handling and has an improved property of fabrication.

Still other object of the invention is to provide a pellet of a mixture for fabricating the metal matrix composite which is safe against explosion even when the mixture includes a explosive metal powder such as a powder of aluminum, magnesium, or titanium.

Further object of the invention is to provide a method of preparing the above-described pellet, in which a slurry of the mixture is continuously removed of its solution medium.

Many other advantages, features and additional objects of the present invention will become manifest to those versed in the art upon making reference to the detailed description and the accompanying drawings in which preferred embodiments incorporating the principles of the present invention are shown by way of illustrative examples.

BRIEF DESCRIPTION OF THE ACCOMPANYING DRAWINGS

DETAILED DESCRIPTION

Figure 1:
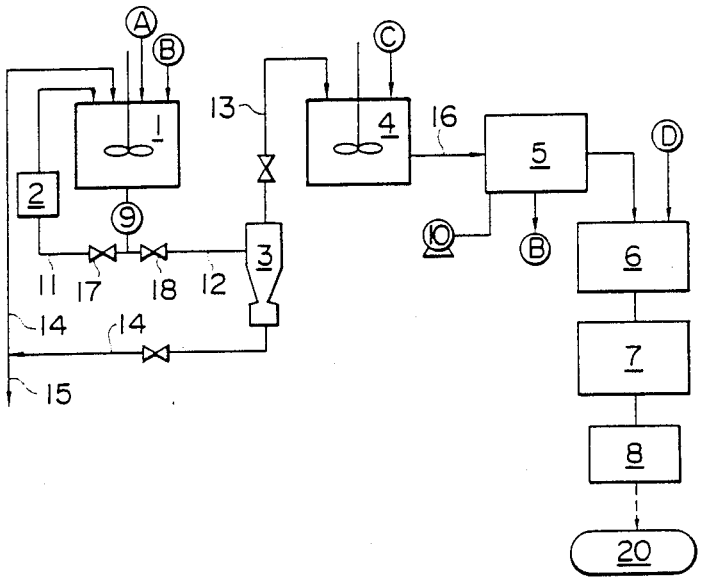
FIG. 1 is a diagram showing a continuous process of manufacturing pellets according to an embodiment of the present invention.

FIG. 1 shows a system for forming a pellet of a mixture for fabricating a final product of a metal matrix composite (MMC) according to the principles of the present invention.

The system includes a blender 1, an ultrasonic horn 2, a wet type cyclone 3, a mixer 4, a dehydrator or apparatus 5 for removing a solution from a slurry, a kneading and granulating machine 6, a drier 7, and a storage vessel 8. These components of the system are operatively connected to each other via pipes or passages of the mixture and control valves. Reference numeral 20 depicts a MMC molding station.

A reinforcement A and a solution medium B are fed into the blender 1 at a controlled rate to prepare a slurry, where the a slurry including a predetermined concentration of the reinforcement is always prepared.

The reinforcement is in the form of a whisker (fine filamentary single crystal), a short fiber or a particle, which is made from boron, carbon, tungsten, molybdenum, stainless steel, boron carbide, boron nitride (BN), or the oxide, nitride or carbide of metal. The reinforcement of one form may be used the reinforcement of other form. Alternatively, the reinforcement may be of the oxide, nitride or carbide of a metal such as silicon or aluminum, namely, a ceramic of silicon carbide, silicon nitride, aluminum oxide, zirconium oxide, titanium carbide, or titanium nitride. The solution medium is a less toxic solution which is not reactive with a metal and will not produce impurities when the same is removed from the slurry thereof. Preferably, the solution medium has a boiling point of no lower than 60 degrees centigrade and no higher than 200 degrees centigrade. To this end, the solution medium may includes at least one of ethyl alcohol, n-butanol, 1-pentanol, isopropyl alcohol, cyclohexane, toluene, n-hexane, methyl alcohol and water.

The slurry is then fed via a passage or pipe 12 with a control valve 18 opened under the pressure of a slurry pump 9 from the blender 1 to the cyclone 3. If necessary, the slurry is partially fed via a passage 11 provided with a control valve 17 to the ultrasonic horn 2, where the reinforcement such as whiskers are separated from one another to be dispersed in the solution medium. The thus treated slurry is returned to the blender 1. The treatment of the slurry by the ultrasonic horn is selectively operated by open and/or close the two control valves 17, 18. In the cyclone 3, the slurry is separated into one slurry portion containing single reinforcement dispersed therein and the other slurry portion containing tightly tangled fibers and other inclusions. Said one slurry portion is fed downstream to the mixer 4 via a passage 13, while the other slurry portion is returned to the blender 1 via a return passage 14.

When the slurry portion is returned to the blender 1, the inclusions thereof is gradually accumulated in the passage 14 since the slurry is condensed during the circulation of the same within the closed path defined by the passages 12 and 14. To this end, a portion of the slurry returned from the cyclone 3 is periodically drained out via a discharging port 15 disposed in the passage 14. Alternatively, it may be normally drained out.

A predetermined amount of a matrix member is added to the slurry in the mixer 4 such that the newly prepared slurry or mixture slurry has a predetermined ratio of the reinforcement to the matrix member.

The matrix member is a metal powder of aluminum, magnesium, titanium, nickel, copper or iron, or alloy of one of these metals.

The reinforcement/metal powder ratio is determined such that the product made from the slurry contains 5 to 40 weight % of the reinforcement. The reinforcement of less than 5 weight % will lose its reinforcing effect. On the other hand, the reinforcement of more than 40 weight % will cause deterioration of ductility and toughness of the final product of metal matrix composite, and thus impairing the plasticity of the latter.

The mixture slurry having its contents uniformly mixed is fed via a passage 16 to the continuous dehydrator or liquid-removing apparatus 5, where the mixture slurry is subject to a suction force produced by a suction means 10 to force the liquid or solution medium of the latter to pass through a filter, and thus forming a flat cake or sheet of the mixture on the filter. The dehydrator 5 may be a typical continuous dehydrating or drainage machine of a drum type or a belt type which is usually used in the chemical industry.

The thickness of the flat cake is 1 to 150 mm, and preferably 1 to 100 mm. The flat cake of less than 1 mm in thickness is difficult to be detached from the belt surface or the drum surface, while the cake of more than 150 mm in thickness is difficult to be controlled to minimize variation of reinforcement in the direction of thickness thereof. The flat cake having the thickness up to 100 mm facilitates the sucking the solution medium therethrough during the suction filtration at the dehydrator 5.

Figure 2:
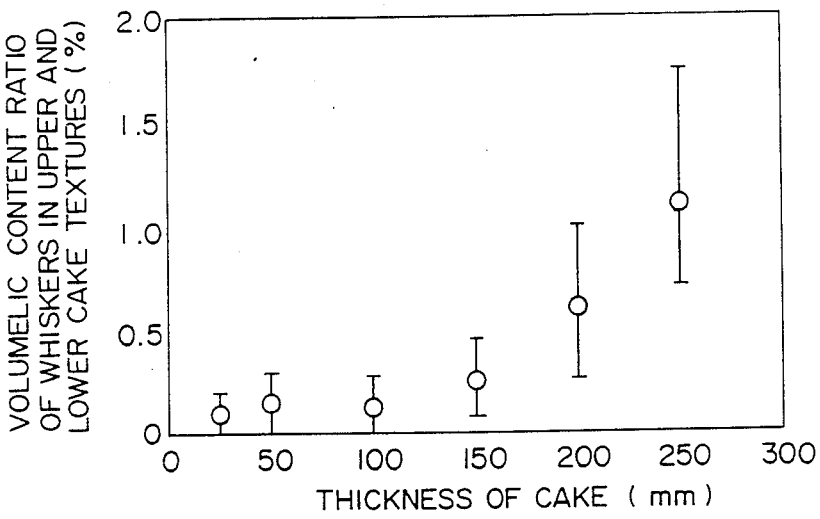
FIG. 2 is a chart showing a relation between a cake thickness and difference of whisker content between upper and lower portion of cake.

FIG. 2 shows a test result concerning a relation between thickness of the cake and difference of whisker content between upper and lower portions of the cake. The cake includes the whiskers of silicon carbide and the powder of aluminum alloy. The whisker content is determined by measuring concentration of carbon (of silicon carbide) contained in a sampled portion of cake and converting the measured value to concentration of silicon carbide. As shown in FIG. 2, the cake will have a relatively well mixed materials, namely of less than 0.5% of difference of whisker content when the flat cake has a thickness of no more than 150 mm.

The flat cake formed by removing the solution medium is fed to the kneading and granulating machine 6, where the cake and a granulation binder D added thereto are kneaded to be shaped or granulated into pellets of granules in a spherical, cylindrical, or rotated oval form. Preferably, the cake may contain the solution medium of 10 to 30 weight %, more suitably 15 to 25 weight % during the granulation, since the cake containing a suitable degree of remaining solution medium will not cause an objectionable mechanical damage of the reinforcement even when the cake is kneaded excessively, and further keep the reinforcement free from being segregated from the metal powder.

The granulation binder may be soluble with the solution medium used for forming the slurry in which the reinforcement is dispersed, and may be dissolved at a temperature lower than the temperature at which the MMC is molded. For instance, the consolidating temperature is 650 to 500 degrees centigrade if the matrix member is of aluminum alloy 6061. Particularly, the binder can include a synthetic resin such as acrylic resin. Concentration of the binder depends upon the materials of the binder and of the cake and may vary from 1 to 10 weight part per 100 weight part of the cake.

The pellet may preferably have the minimum diameter of 0.1 to 5 mm. The minimum limit value 0.1 mm is determined in view of ease of the handling and the size of the reinforcement, i.g. a length of a whisker, namely, 200 micron meter. The maximum limit value 5 mm is determined in view of deaeration and heat transfer required for drying of pellets and removing of the binder (during preheating of the pellets for consolidating the MMC.)

In this particular system shown in FIG. 1, the kneading and granulating machine 6 is of a single unit type. However, the two functional units may be provided separately. The granulation method is preferably extruding granulation or compression granulation both of which is less likely to impair the structure or texture of uniformly mixed mixture.

Figure 3:
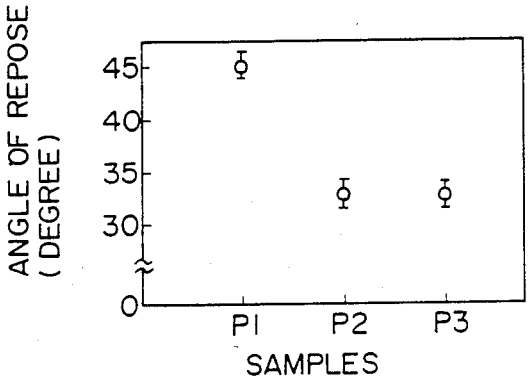
FIG. 3 is a chart showing an angle of repose of different sample mixtures for MMC.

Contribution of the material-pelleting to packing for consolidating has been verified by testing fluidity of the pelleted material, particularly, of whiskers and non-pelleted material. FIG. 3 shows a test result concerning the angle of repose of three different samples P1, P2 and P3. The sample P1 is a mixture of whiskers and a metal powder. The samples P2 and P3 are pellets formed of said mixture and have a diameter of 1 mm and 2 mm, respectively. As shown in FIG. 3, the samples or pellets P2 and P3 have a relatively small angle of repose, that is, a high degree of fluidity in comparison with the sample P1. The high degree of fluidity permits the pellet to be packed with an increased efficiency into a mold by which the mixture is formed into the final product of the MMC.

The thus formed pellets are transferred immediately thereafter to the drier 7, where the pellets are dried by hot gas drying in the ambience of the air or an inert gas of a temperature higher than the boiling point of the solution medium of the slurry to such an extent that the pellets will not collapse when they are stored. Then the dried or semi-dried pellets are stored in the storage vessel 8.

The pellets are dried to such an extent that the surface textures or layers become dry and rigid enough to keep their shape under an external pressure applied thereto, and need not to be necessarily dried as completely as their cores are dried prior to the storage. The pellet, even when dried incompletely, can be stored in a good condition because of its good permeability. Pellets define gaps or openings in between any pair of adjacent pellets, and thus making the same to be dried efficiently with the result that the time of drying is shortened.

Removal of the remained solution medium from the pellets is carried out by purging the same with an inert gas within the storage vessel. It can be also removed during the preheating for removal of the binder within the mold for consolidating the MMC. The inert gas may be an argon gas or a nitrogen gas. The inert gas may be used within a closed path such that the gas is recirculated after the vapor of solution medium is collected from the gas.

The above-described system performs the processes of preparation of slurry, removal of liquid, and granulation continuously. Alternatively, each process may be exerted independently, although the continuous operation is most preferable in view of productivity.

In case the reinforcement is in the form of particles, the mixing of the matrix powder and the reinforcement can be exerted relatively easily without preparing the slurry which is required for the filamentary material such as whiskers or short fibers as described hereinabove. In this case, the mixture is added with the granulation binder diluted with a solution medium in the granulation process before it follows the downstream processes described hereinabove.

The pellets stored in the storage vessel 8 are supplied to the downstream station 20 for consolidating the MMC.

EXAMPLE 1

(1) Whiskers of silicon carbide and an organic solution medium of ethanol for dispersing the latter were fed into the blender 1 to prepare a slurry of whisker concentration of 3.0 volume %.

The slurry was treated by the ultrasonic horn 2 and the cyclone 3 so as to have the whiskers uniformly mixed therein, and then fed to the mixer 4, where the slurry was mixed metal particles of aluminum alloy to prepare the mixture slurry of 20 volume % silicon carbide whiskers and 80 volume % aluminum alloy powder.

(2) The mixture slurry was removed of the solution medium of ethanol by the belt type continuous dehydrator 5 to form a flat cake of approximately 7 mm in thickness. The dehydrator was controlled to suck the ethanol such that the cake contains the ethanol of 20 weight %.

The filtration continued approximately 1 minute, which is about 1/20 (one twentieth) of the conventional filtration by means of a batch type dehydrator.

(3) To the cake was added a binder of acrylic resin at the ratio of 6 weight part per 100 weight part of the cake, and was kneaded to be granulated into pellets in the form of a cylindrical shape of 1 mm in diameter and 1.6 mm of an averaged length.

(4) The pellets were immediately transferred to the drier 7, where they were dried by a hot nitrogen gas. The dried pellets were stored in the storage vessel 8.

It took approximate 6 minutes to dry the pellets of 10 kg to such an extent that the surface layer thereof becomes rigid enough to endure the pressure applied thereto when they are piled in the storage vessel. The drying time of the present system was shortened to 1/15 to 1/20 of that of the conventional system.

(5) The pellets were consolidated into a billet of MMC by the hot pressing method. A mixture of the same components prepared by the conventional method was also consolidated into a billet of MMC for comparing with the product made according to the invention in view of tensile strength at the room temperature.

Figure 4:
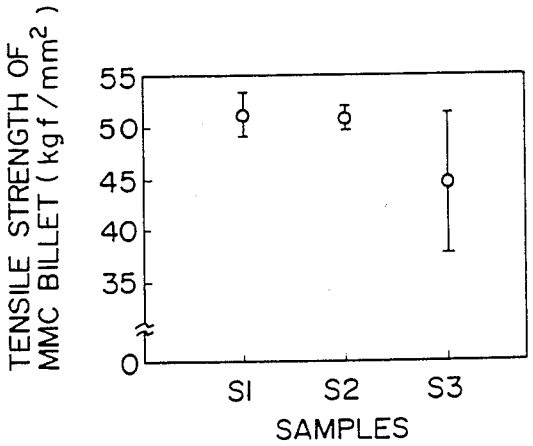
FIG. 4 is a chart showing a relation between different MMC mixtures charged into the mold in different manners and a tensile strength of billets made from the latter.

FIG. 4 shows the result of the comparison. A sample piece S1 of MMC was made from the conventional mixture which was filled in the mold by manually placing the mixture in layers uniformly one over another. A sample piece S2 was made from the pellets which were charged at a time into the mold through one port and then tapped on the surface of the charged material. A sample piece S3 was made from the same material of the sample piece S1 which was charged into the mold by the same method of the sample piece S2.

The sample piece S1 achieved satisfactory results of the tensile strength and variance thereof. However, the charging method is too impractical to be employed for manufacturing process.

The sample piece S2 achieved the results similar to that of the sample piece S1, although the charging method was much simpler and thus more efficient than that of the latter. The variance of the tensile strength is smaller than that of the sample S1. This result also indicates that the binder was completely removed from the material during the preheating process. The binder remained in the material would deteriorate the mechanical strength of the product.

The sample piece S3 yielded a great variance of the tensile strength and the averaged strength was lower than those of the sample pieces S1 and S2.

EXAMPLE 2

(1) Whiskers of silicon carbide and an organic solution medium of isopropyl alcohol for dispersing the latter were fed into the blender 1 to prepare a slurry of whisker having concentration of 10 volume %.

The slurry was treated by the ultrasonic horn 2 and the cyclone 3 so as to have the whiskers uniformly mixed therein, and then fed to the mixer 4, where the slurry was mixed with a metal powder of aluminum alloy 2024 to prepare the mixture slurry of 25 volume % silicon carbide whiskers and 75 volume % aluminum alloy 2024 powder.

(2) The mixture slurry was removed of the solution medium of isopropyl alcohol by the belt type continuous dehydrator 5 to form a flat cake of approximately 50 mm in thickness. The dehydrator was controlled to suck the isopropyl alcohol such that the cake contains the isopropyl alcohol of 17 weight %.

The filtration continued approximately 1.5 minutes. Difference of silicon carbide content between upper and lower portions of the cake was small, namely 0.2%, which means that the components of the cake were uniformly distributed.

(3) To the cake was added with a binder of acrylic resin at the ratio of 4 weight part per 100 weight part of the cake, and was kneaded to be granulated into pellets in the form of a cylindrical shape of 2 mm in diameter and an averaged length of 2 mm.

(4) The pellets were immediately transferred to the drier 7, where they were dried by a hot nitrogen gas. The dried pellets were stored in the storage vessel 8.

It took approximately 10 minutes to dry the pellets of 10 kg to such an extent that the surface layer thereof becomes rigid enough to endure the pressure applied thereto when they are piled in the storage vessel. The drying time of the present system was shortened to 1/9 to 1/12 of that of the conventional system.

(5) The pellets were charged into the mold of 50 cm in depth from an upper port thereof. Difference of silicon carbide content within the mold was 0.2% which was similar to that of the cake and thus the pellets were not subject to the segregation of the components. The charging operation was free from the dust. For the purposes of comparison, the mixture of the components prepared in the conventional manner was also charged into the similar mold in the similar manner, resulting in that the difference of silicon carbide content within the mold was 3.4% and segregation of the silicon carbide particles and the aluminum alloy powder took place. In addition, the dust were objectionably produced.

Figure 5:
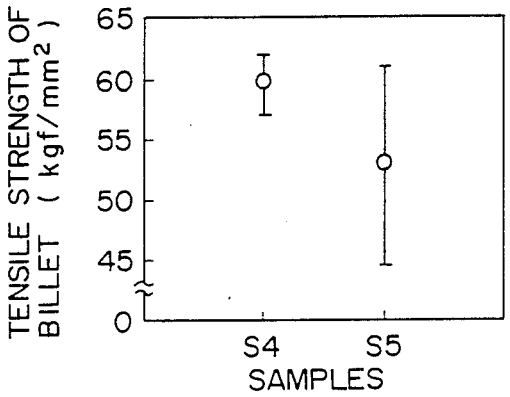
FIG. 5 is a chart showing difference of tensile strength of billets made from the pellets and the conventional mixture, the pellets being made from the slurry of a mixture prepared according to one aspect of the invention.

(6) The two materials described hereinabove were consolidated into a billet of MMC by the hot pressing method, respectively, and the tensile strength of the respective products or billets were compared with each other. FIG. 5 shows the result of comparison, in which sample pieces S4 and S5 were made from the pellets of the invention and the conventional mixture of particles and powder, respectively. The sample piece S4 exhibited a relatively high tensile strength and a small variance thereof in comparison with the sample piece S5.

EXAMPLE 3

(1) Particles of aluminum oxide and fine particles of aluminum alloy 7075 were mixed by a V-type mixer to prepare a dry mixture of 30 volume % aluminum oxide particles and 70 volume % of aluminum alloy 7075 powder.

(2) The mixture of 10 kg was added with ethanol of 2000 g containing a granulation binder of acrylic resin of 500 g solved therein and then kneaded to be granulated into pellets in the form of a cylindrical shape of 0.5 mm in diameter and an averaged length of 1 mm.

(3) The pellets were dried by a hot nitrogen gas in the drier to such an extent that the surface layer thereof become rigid enough to endure the pressure applied thereto when they are piled in the storage vessel.

(4) The pellets were charged into the mold of 70 cm in depth from an upper port thereof. Variance of aluminum oxide content within the mold was 0.3%, and the pellets were not substantially subject to the segregation of the components. The charging operation was free from the dust. For the purposes of comparison, the conventional mixture of the aluminum oxide particles was also charged into the similar mold in the similar manner, resulting in that the variance of aluminum oxide content was relatively great, namely 6.4%, and segregation of the aluminum oxide particles and the aluminum alloy powder took place. In addition, the dust were produced to a considerably great extent.

Figure 6:
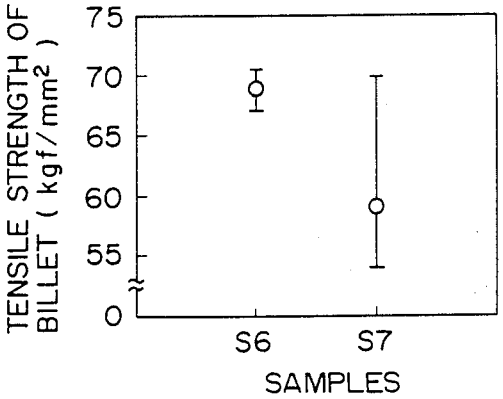
FIG. 6 is a chart similar to FIG. 5, the pellets being made from a dry mixture prepared according another aspect of the invention.

(5) The two materials described hereinabove were consolidated into a billet of MMC by the hot pressing method, respectively, and the tensile strength of the respective products or billets were compared with each other. FIG. 6 shows the result of comparison, in which sample pieces S6 and S7 were made from the pellets of the invention and the conventional dry mixture of particles and powder, respectively. The sample piece S6 exhibited a relatively high tensile strength and a small variance thereof in comparison with the sample piece S7.

With the arrangement described hereinabove, provision of pellets as the mixture for fabricating the metal matrix composite improves the fluidity for charging to the mold, and fabrication as well as the strength and quality of the product of MMC.

The mixture pelleted according to the present invention is kept free from separation of the reinforcement from the matrix member until it is consolidated into the final product, and is easy to be filled or packed densely into the mold. Since the size of the pellet is larger than the maximum size for explosion, the pellet is free from explosion even when the mixture includes the explosive metal powders such as powders of aluminum, magnesium and titanium. The pellet acquires a high fluidity facilitating the dense packing even when it is dried only on its surface texture. Therefore the drying time is also shortened by a substantial degree. Forming the flat cake of the controlled thickness permits that the time necessary for removal of the solution medium from the mixture slurry can be shortened, and that the components of the cake can be uniformly distributed therein. All those advantages of the method of the present invention contributes to improvement of the productivity.

Although various minor modifications may be suggested by those versed in the art, it should be understood that I wish to embody the scope of the patent warranted hereon, all such embodiments as reasonably and properly come within the scope of my contribution to the art.

What is claimed is:

1. A pellet consisting essentially of a mixture of a matrix member of a metal powder and at least one reinforcement selected from whiskers, short fibers and particles, the reinforcement being uniformly distributed in a matrix of the metal powder and said mixture being kept in a shape with a binder, wherein said pellet has a surface layer of dried and rigid portion of said mixture which is rigid enough to keep its shape under an external compressing force applied thereto.

2. A pellet according to claim 1, said reinforcement being a material selected from boron, carbon, tungsten, molybdenum, stainless steel, boron carbide, boron nitride (BN), or oxide, nitride or carbide of metal.

3. A pellet according to claim 1, said pellet being of a spherical form having a minimum diameter of 0.1 to 5 mm.

4. A pellet according to claim 1, said pellet being of a cylindrical form having a minimum diameter of 0.1 to 5 mm.

5. A pellet according to claim 1, said pellet being of a rotated oval form having a minimum diameter of 0.1 to 5 m.

6. A pellet according to claim 1, said metal powder being selected from aluminum, magnesium, titanium, nickel, copper, or iron, or alloy of one of said metals.

7. A pellet according to claim 1, said pellet including said reinforcement of 5 to 40 weight %.

8. A pellet according to claim 1, said pellet having an angle of repose of no more than 35 degrees.

9. A pellet according to claim 1, made by the method comprising the steps of:

preparing a slurry consisting of a solution medium in which the matrix member and the reinforcement are mixed with each other in a uniformly distributed condition;

removing continuously the solution medium from the slurring for forming a flat cake of the mixture of the matrix member and the reinforcement;

kneading the cake with a granulation binder added therein to make the cake into small pieces or pellets; and drying the pellets such that the pellets have a rigid and dried surface layer.

10. A pellet according to claim 9, wherein in said method said flat cake has a thickness of 1 to 150 mm.

11. A pellet according to claim 9, wherein in said method said solution medium includes at least one of ethyl alcohol, n-butanol, 1-pentanol, isopropyl alcohol, cyclohexane, toluene, n-hexane, methyl alcohol and water.

12. The pellet according to claim 9, wherein in said method the solution medium of said slurry is removed so that the said cake contains the solution in an amount of 10 to 30 weight %.

13. A pellet according to claim 9, wherein in said method the granulation binder added to said cake is 1 to 10 weight part with respect to the total weight of said cake.

14. A pellet according to claim 1, made by the method comprising the steps of:

preparing the mixture of the matrix member and reinforcement mixed with each other in a uniformly distributed condition under dry mixing condition;

kneading the mixture with a granulation binder added therein to make said mixture into small pieces or pellets, said granulation binder being diluted with a solution medium; and drying the pellets such that the pellets have a rigid and dried surface layer.

* * * * *